US010167692B2

(12) United States Patent
Whitmer et al.

(10) Patent No.: US 10,167,692 B2
(45) Date of Patent: Jan. 1, 2019

(54) WELL CASING SECURITY DEVICE

(71) Applicants: Gerald T. Whitmer, Shenandoah Junction, WV (US); B. Lee Snyder, Kearneysville, WV (US)

(72) Inventors: Gerald T. Whitmer, Shenandoah Junction, WV (US); B. Lee Snyder, Kearneysville, WV (US)

(73) Assignee: WELL SAFE, LLC, Kearneysville, WV (US)

( * ) Notice: Subject to any disclaimer, the term of this patent is extended or adjusted under 35 U.S.C. 154(b) by 451 days.

(21) Appl. No.: 15/143,655

(22) Filed: May 2, 2016

(65) Prior Publication Data

US 2017/0314356 A1 Nov. 2, 2017

(51) Int. Cl.

| | |
|---|---|
| ***E03B 3/16*** | (2006.01) |
| ***B65D 55/14*** | (2006.01) |
| ***E21B 33/02*** | (2006.01) |
| ***E21B 41/00*** | (2006.01) |

(52) U.S. Cl.

CPC ..... *E21B 33/02* (2013.01); *B65D 55/14* (2013.01); *E03B 3/16* (2013.01); *E21B 41/0021* (2013.01); *Y10S 285/901* (2013.01)

(58) Field of Classification Search

CPC ..... E21B 33/00; E21B 33/02; E21B 33/03; E21B 41/0021; E03B 3/16; B65D 55/02; B65D 55/14; Y10S 285/901

USPC ..... 166/75.13, 92.1, 379

See application file for complete search history.

(56) References Cited

U.S. PATENT DOCUMENTS 1,578,194 A * 3/1926 Edelman ..... E03F 5/02 220/260
1,791,277 A * 2/1931 Lake ..... F16L 55/1155 215/277
2,179,191 A * 11/1939 McWilliams ..... E21B 33/03 138/89
2,566,870 A * 9/1951 Beagle ..... E03B 9/10 220/293
3,035,732 A * 5/1962 Baker ..... E21B 33/03 166/75.13
3,394,836 A * 7/1968 Millard ..... B65D 90/54 220/210
3,473,573 A * 10/1969 Baker ..... E21B 33/00 138/89
3,672,403 A * 6/1972 Wilson ..... F16L 55/1157 138/89

(Continued)

*Primary Examiner* — Blake E Michener

(74) *Attorney, Agent, or Firm* — Jackson Patent Group, LLC

(57) ABSTRACT

A well casing security device and method. The security device includes a cover including a sidewall, a top, one or more stabilizers, and a means for attaching the cover to a well casing or to its concrete slab to render it vandal-resistant. A locking support ring is provided for attachment to either the well casing or to the concrete slab surrounding the casing. The locking support ring includes a ring body with a plurality of braces. Each of the braces includes an arm defining a slot between the arm and the ring body. The cover includes a plurality of brackets enabling rotational engagement cover with the locking support ring. Locking means are provided on the cover to lock the cover to the locking support ring. The locking means includes a key operated lock that is tamper resistant and insures that the well casing cannot be accessed easily by an intruder.

22 Claims, 8 Drawing Sheets

(56) References Cited

U.S. PATENT DOCUMENTS 3,722,549 A * 3/1973 Wilson ..... F16L 55/1157 138/89
3,782,146 A * 1/1974 Franke ..... E05B 73/00 166/85.1
3,949,787 A * 4/1976 Milo ..... F16L 55/115 138/89
4,233,697 A * 11/1980 Cornwall ..... E03D 11/16 138/89
4,334,578 A * 6/1982 Labrum ..... B65D 55/14 166/75.13
4,411,312 A * 10/1983 English ..... E21B 33/03 166/75.13
4,842,060 A 6/1989 Paulus
4,848,458 A * 7/1989 Holdsworth ..... E21B 33/03 166/92.1
4,881,597 A * 11/1989 Hensley ..... E21B 33/03 166/92.1
4,887,669 A 12/1989 Paulus
5,111,879 A 5/1992 Jozwiak
5,184,608 A * 2/1993 Hale ..... E21B 33/03 138/89
5,329,971 A * 7/1994 Condon ..... E03D 11/16 138/89
5,437,309 A * 8/1995 Timmons ..... F16L 55/115 138/89
5,641,017 A * 6/1997 Drake ..... E05B 67/383 166/92.1
6,105,669 A 8/2000 Davis
7,621,340 B2 * 11/2009 Cuthill ..... E21B 33/02 137/371
8,230,928 B2 * 7/2012 Cuiper ..... E21B 33/035 138/89
8,342,210 B2 * 1/2013 Vachon ..... F16L 55/1157 138/89
9,121,243 B1 * 9/2015 Headifen ..... E21B 33/02
2011/0048726 A1 * 3/2011 Aarnes ..... E21B 23/02 166/339
2015/0034295 A1 * 2/2015 Osborne ..... E21B 41/0021 166/75.11
2015/0082713 A1 * 3/2015 Stanton ..... E05B 17/2034 52/79.1

* cited by examiner

WELL CASING SECURITY DEVICE

FIELD OF THE INVENTION

This invention relates to security of wells, and specifically to a device and method for providing security to a well casing.

BACKGROUND OF THE INVENTION

Many people rely on wells, both privately owned and publically owned and managed, for providing their water supply, including drinking water, water for washing, and other needs. Well sources for public water utilities are continually relied upon to provide millions of customers with safe potable drinking water. The water wells are characterized by well casings that extend from the earth, sometimes with a concrete well cover at the ground surface. The well casing typically is constructed of steel, extends from deep in the well bore, and terminates above the ground surface.

Unfortunately, conventional water wells are easily accessible and may be located in remote areas that are not routinely monitored. The wells and their precious water supply are thus easily susceptible to vandalism or terrorism. The vandalism may range from neighborhood children dropping rocks or other items into the well to dangerous and terroristic acts such as purposeful poisoning of the well with chemical or radioactive substances. Some well owners, especially public water utilities may go to the expense of erecting a fence around the well, but fences can be easily climbed, cut, or otherwise compromised. Although a padlock can be used to limit access to a well casing, it is simple for a person to remove the padlock by using bolt cutters, metal saws, or a hammer. In fact, most well casing caps are cast metal, held on by easily removing set screws. These caps are easily removed or shattered.

Accordingly, it would be desirable to provide a device and method to protect a well casing, in order to insure a safe and uncontaminated water supply to those millions of people depending on water from wells who unwittingly think their water supply is safe.

BRIEF SUMMARY OF THE INVENTION

The invention is a well casing security device and method. The security device includes a cover, and a locking support ring which provides a means for attaching the cover to a well casing or to its concrete slab to render it much more vandal-resistant. The top surface of the locking support ring includes a plurality of braces. Each of the braces includes an arm defining a slot between the arm and the support base. The cover includes a plurality of brackets for engaging the locking support ring. The brackets of the cover and braces of the locking support ring enable rotational engagement of the brackets with the locking support ring. A first embodiment of the well casing security device enables attachment of a secure cover to the well casing at a point above ground level. A second embodiment enables attachment of the well casing security device to the concrete base surrounding a well casing. Locking means are provided on the cover to lock the cover to the locking support ring that is attached to the well casing or its concrete slab. The locking means includes a key operated lock that is resistant to tampering and insures that the well casing cannot be accessed without substantial effort and reconcilable disruption by an intruder. Shielding means are provided on the cover to prevent easy removal of the lock. Stabilizers mounted on the cover or the locking ring stabilize the cover with respect to the well casing. The device provides a level of security for wells to protect the critically important safety and reliability of the water they supply. The device can be easily installed on existing wells where the well casing extends above grade and the well has a pitless adaptor.

OBJECTS AND ADVANTAGES

A first object of the invention is to provide a well casing security device to prevent unauthorized access to a well casing.

A second object of the invention is to provide a well casing security device that can be easily adapted to cover a conventional well casing in order to provide security by limiting access to the well casing.

A further object of the invention is to provide a lockable well casing security device that may be easily removed from a well casing by an authorized operator.

Another object of the invention is to provide a secure cover for a well casing that is sturdy and not easily broken off its connection to the well casing or easily removed with ordinary hand tools.

A further object of the invention is to provide a well casing security device enables authorized access via a lock and complimentary key.

Another object of the invention is to provide a well casing security device that includes features for preventing easy removal of the device or its lock by an unauthorized individual.

These and other objects and advantages of the present invention will be better understood by reading the following description along with reference to the drawings.

DETAILED DESCRIPTION

Figure 7:
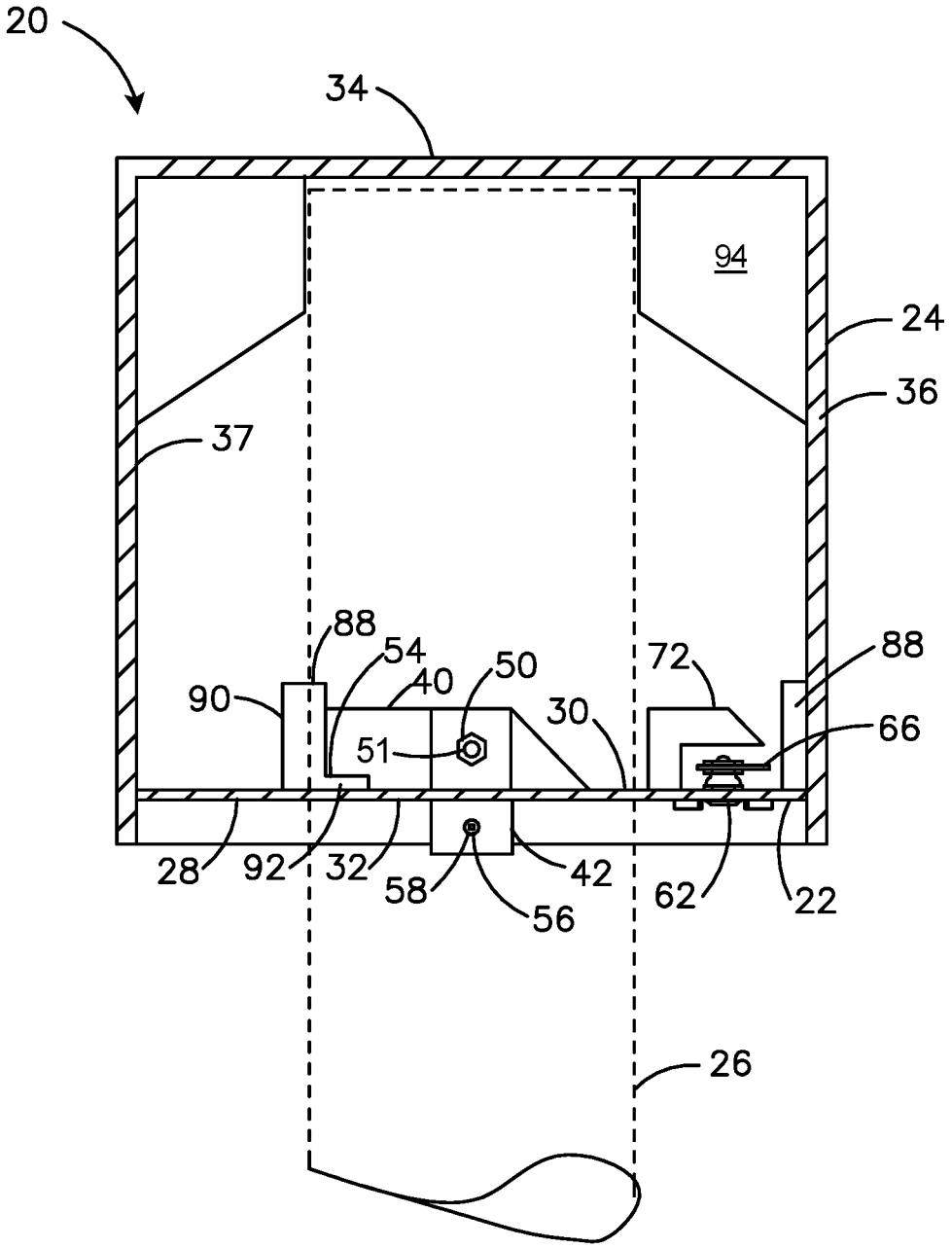
FIG. 7 is a sectional view of the well casing security device taken along line 7-7 of FIG. 1.

With reference to FIG. 7 there is shown a well casing security device 20 including a locking support ring 22 and a cover 24 for guarding against unauthorized access to the well casing 26. The locking support ring 22 includes a ring body 28 having a top surface 30, a bottom surface 32. The cover 24 includes a top 34 and a sidewall 36 with an inner surface 37.

Figure 1:
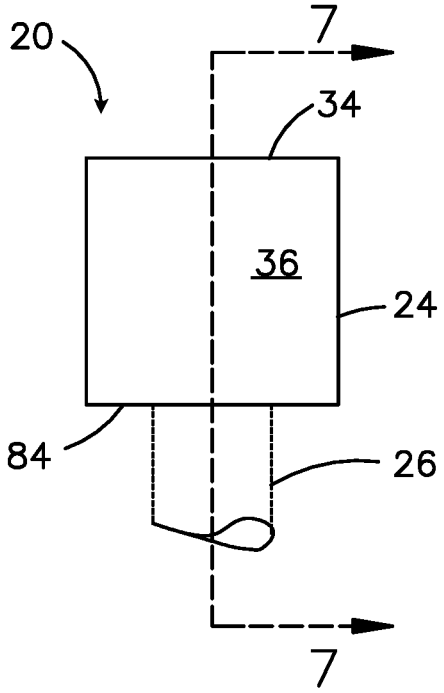
FIG. 1 is a side view of a first embodiment of a well casing security device according to the present invention.
Figure 2:
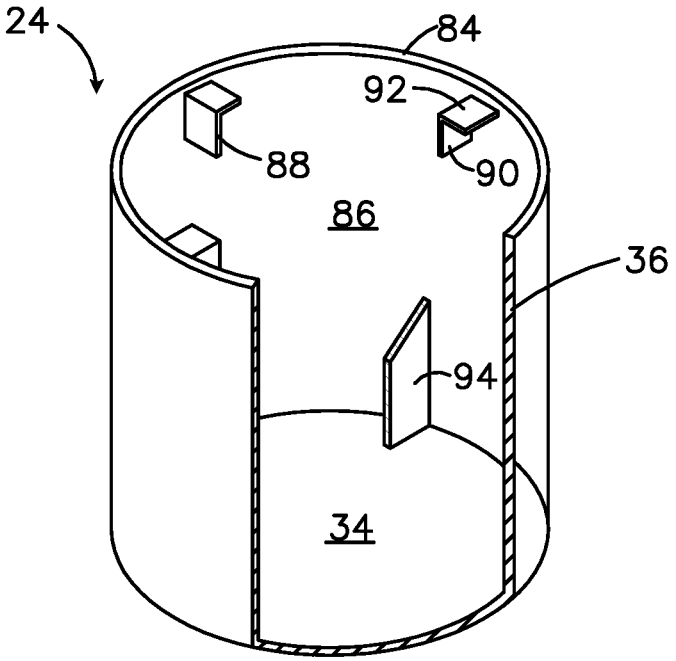
FIG. 2 is an isometric view the cover portion of the well casing security device of FIG. 1, with a portion of the cover cut away.
Figure 3:
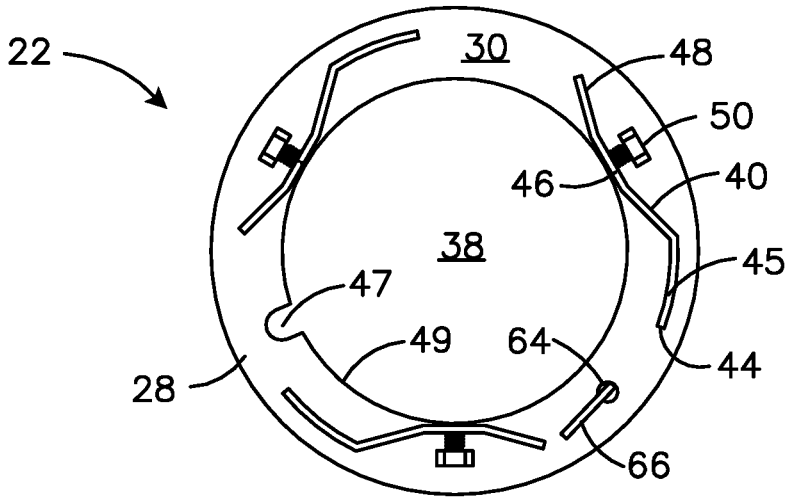
FIG. 3 is a plan view of the top surface of a locking support ring that forms a portion of the well casing security device in FIG. 1.
Figure 4:
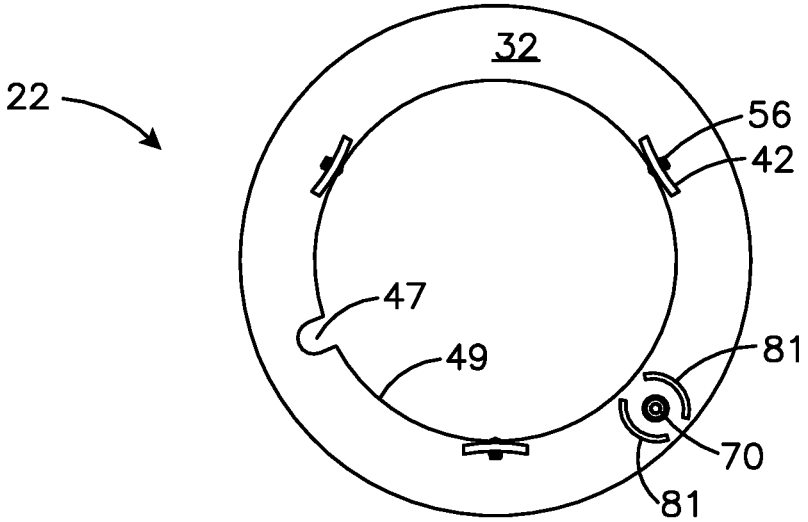
FIG. 4 is a plan view of the bottom surface of the locking support ring.

Referring to FIGS. 3 and 4, the locking ring 22 further includes an opening 38 to accommodate the well casing 26 (see FIG. 7), a plurality of braces 40 extending from the top surface 30 of the ring body 28, and a plurality of positioning brackets 42 extending from the bottom surface 32 of the ring body 28. The braces 40 include a leading end 44 having an arcuate shape to engage the brackets on the interior of the cover 24 (see FIG. 2). The cover is of a radius to tightly slide over the outer radius of the ring body 28. Each brace 40 further includes a cover engagement portion 45, a casing engagement portion 46 and a stiffening portion 48. The casing engagement portions 46 extend to the inner periphery 49 of the body 28. The opening 38 of the ring 22 is sized slightly larger than the outer diameter of the well casing which it will be used in conjunction with, thus the casing engagement portions 46 of the ring will be positioned substantially against the well casing when it is fitted thereto. Ring body 28 further includes a notch 47 therein in the inner periphery 49 of the ring. This notch is provided to accommodate the electrical conduit to supply power to the well pump.

Figure 5:
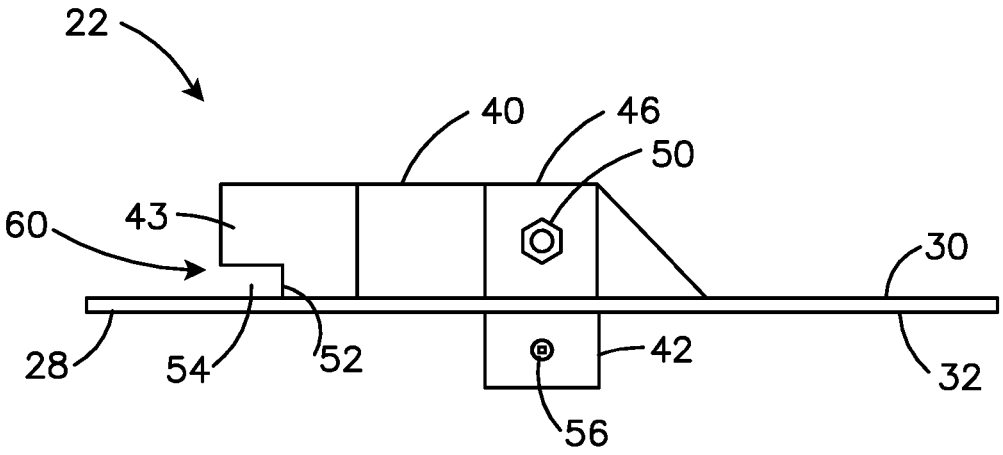
FIG. 5 is a side view of the locking support ring depicting a brace.

With reference to FIG. 5, a locking screw 50 is threaded within each brace 40 at the casing engagement portion 46. Cover engagement portion 45 of brace 40 includes an undercut 52 that forms a slot 54 between cover engagement portion and ring body 28 at the leading end 43 of each brace 40. Each positioning bracket 42 on the bottom surface 32 of the ring body 28 includes a set screw 56 threaded into an aperture 58 in the positioning bracket. The slot 54 forms a portion of a locking means 60 for securing the cover to the locking ring 22.

Figure 6:
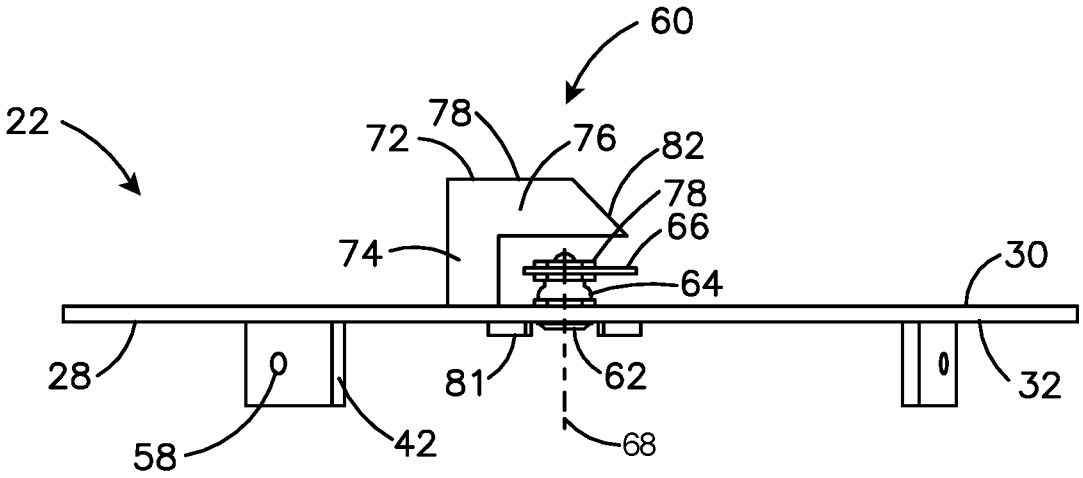
FIG. 6 is a side view of the locking support ring depicting a key guard.

As shown in FIG. 6, the locking means 60 further comprises a key lock 62 including a key body 64 extending through the ring body 28 and a latch 66. The key lock 62 includes a key axis 68 and the latch 66 is preferably perpendicular to the key axis and can be rotated 90 degrees with the key. A key slot 70 (see FIG. 4) is located on the bottom surface 32 of the ring body 28. A lock guard 72 is provided on the top surface 30 of the ring body 28, the lock guard 72 including a base 74 and an arm 76 extending over the latch 66 of the key lock. Arm 76 of lock guard 72 provides a recess 78 for protecting the latch 66 during assembly of the well casing security device as the cover 24 is fitted onto the locking support ring 22. The arm 76 includes a top 79 and bottom 80 and includes an outer edge 82 that slopes outward from top to bottom to facilitate fitting of cover to locking support ring during assembly of the well casing security device. Bottom key guards 81 are further provided on the bottom surface 32 of the ring body 28 to inhibit easy chiseling off of key lock 62.

With reference to FIG. 2, the cover 24 includes a rim 84, an inner surface 86, and a plurality of brackets 88 extending from the inner surface and spaced around the inner periphery of the cover. The brackets 88 are substantially L-shaped and include an upper leg 90 and a lower leg 92. As shown in FIG. 7, the cover 24 further includes a plurality of stabilizers 94 at the top end of the lid for stabilizing the lid with respect to the well casing, the stabilizers extending between the top 34 and the inner surface 37 of the sidewall 36 of the cover 24.

Referring to FIG. 7, the present invention includes a method of covering a well casing so that it is secured against unauthorized access. The method includes: (1) placing the cover 24 on the locking support ring 22 and rotating the cover until the brackets 88 of the cover 24 fully engage the slots 54 in the braces 40 of the locking support ring 22, (2) turning the key lock 62 to lock the cover to the support ring, (3) tightening the set screws 56 against the well casing 26 to position the locking support ring 22 with respect to the well casing, (4) unlocking and removing the cover 24, (5) drilling a hole through the well casing at the location of each of the apertures 51 in the braces 40 on the top side of the locking support ring 22, (6) inserting a locking screw 50 through each of the braces 40 and into the newly created holes in the casing to secure the locking support ring 22 to the well casing 26, (7) placing the cover 24 on the locking support ring and well casing assembly, and (9) locking the key lock 62 to prevent rotation of the cover 24 with respect to the locking support ring 22 and well casing 26 assembly. As an alternative installation method, steps (5) and (6) above can be replaced by welding the locking support ring 22 to the well casing 26, thereby avoiding drilling holes in the well casing.

Figure 8:
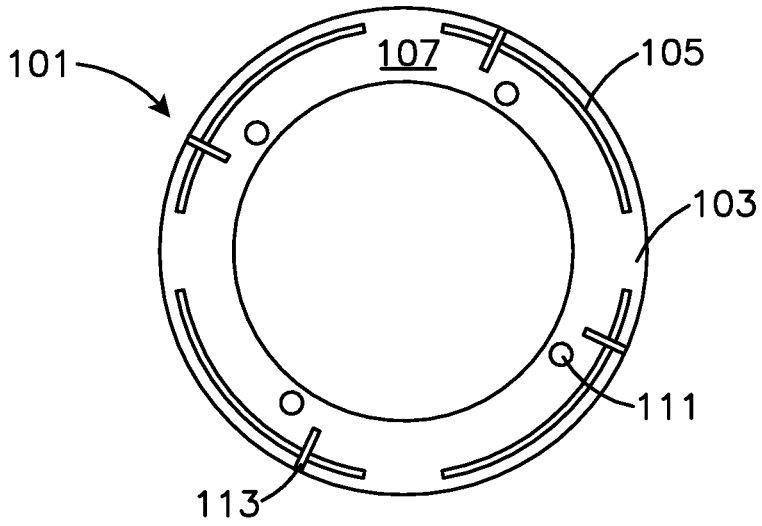
FIG. 8 is a plan view of the top surface of a locking support ring for a second embodiment of the well casing security device.

Referring to FIG. 8, a second embodiment of the well casing security device includes a locking support ring 101 in which the ring body 103 includes braces 105 extending from the top surface 107 of the ring body 103. A plurality of apertures 111 are provided in the ring body through which anchor bolts are placed to secure the locking support ring to the concrete slab around the well casing. A stabilizer 113, integral with and substantially perpendicular to each brace 105, extends from the top surface 107 of the locking support ring 101.

Figure 9:
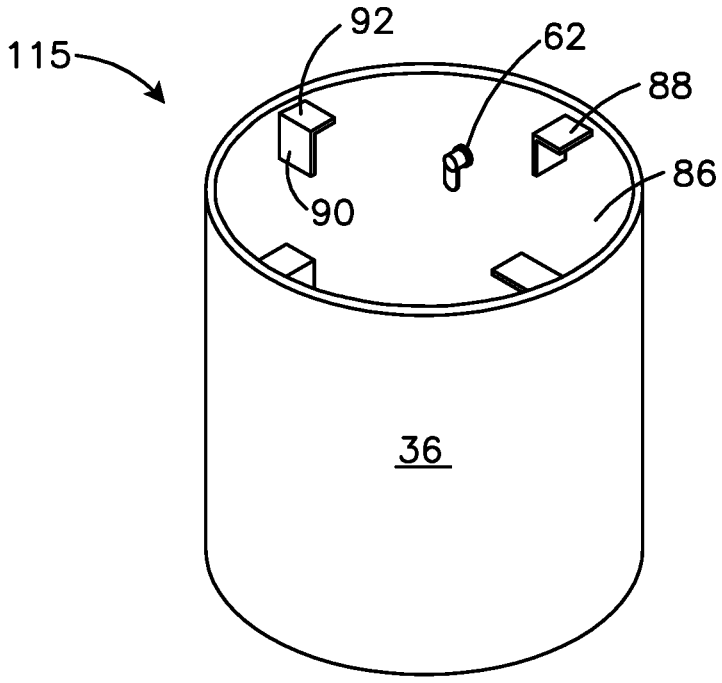
FIG. 9 is an isometric view the cover portion of the second embodiment of the well casing security device.
Figure 16:
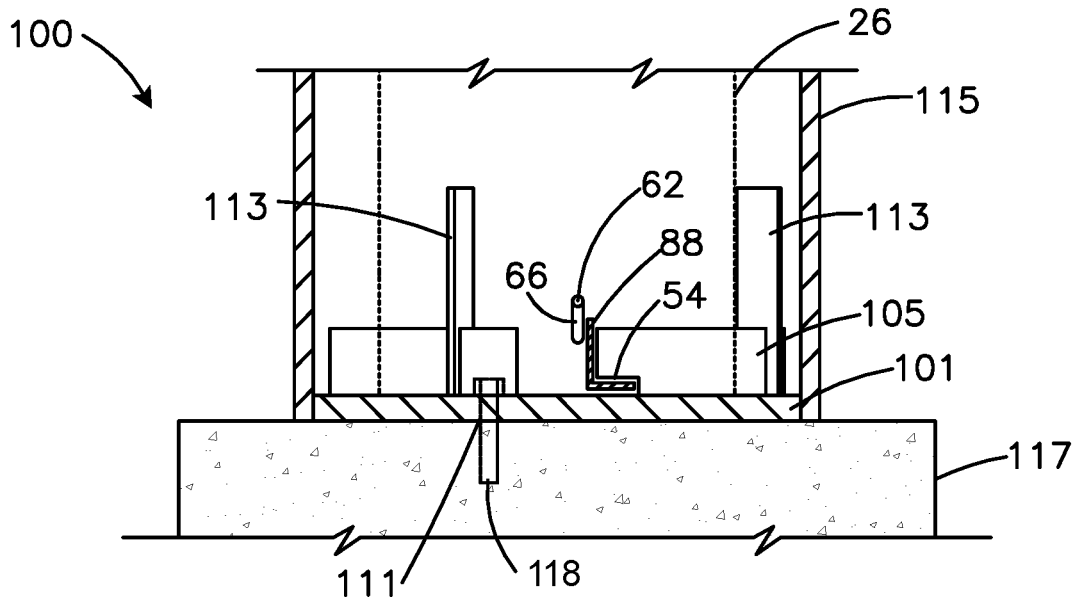
FIG. 16 is a sectional view of the well casing security device taken along line 16-16 of FIG. 11.
Figure 17:
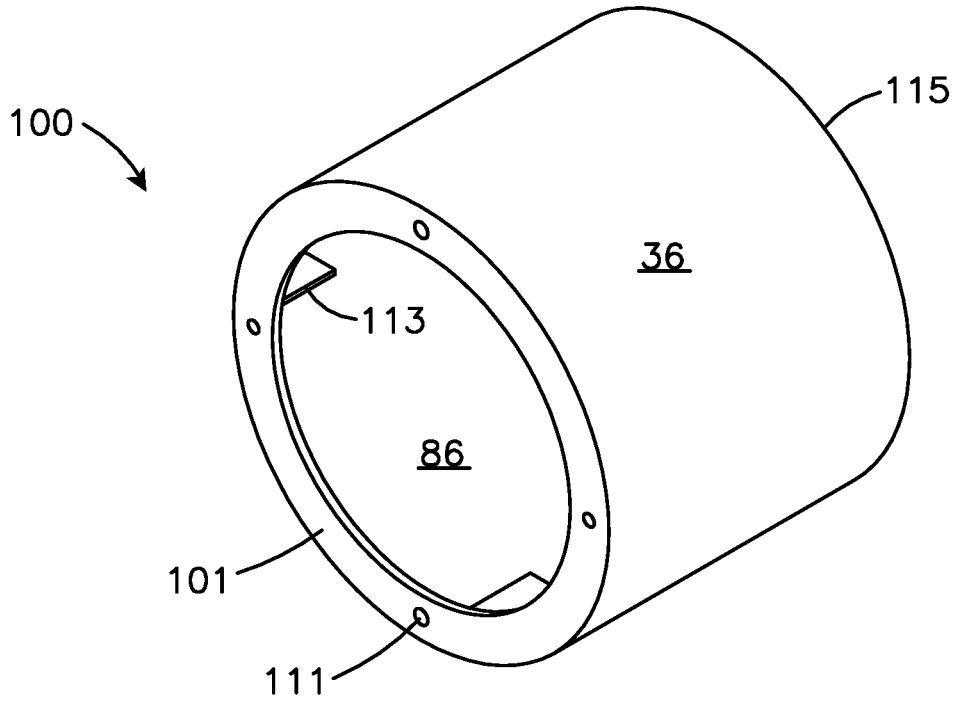
FIG. 17 is an isometric view of the second embodiment of the well casing security device with the cover secured to the locking support ring.

As shown in FIG. 9, the second embodiment of the well casing security device 100 (see FIG. 16) includes a cover 115. As in the first embodiment, the cover 115 of the second embodiment includes brackets 88 that are substantially L-shaped and include an upper leg 90 and a lower leg 92. The cover 115 however includes a key lock 62 mounted directly in the sidewall 36 of the cover. As shown in FIG. 16, in the second embodiment the locking ring 101 is bolted directly to the concrete base or concrete slab 117 surrounding the well casing by anchor bolts 118 through apertures 111 in the locking support ring. After securing the cover 115 to the locking support ring 101, the key 62 is locked and latch 66 in the locked position disables rotation of the cover 115 with respect to the ring 101 thus preventing unauthorized removal of the security lid from the well casing.

Figure 10:
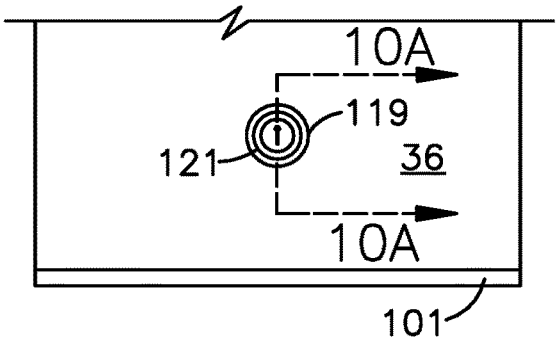
FIG. 10 is a side view of the cover depicted in FIG. 9.
Figure 10A:
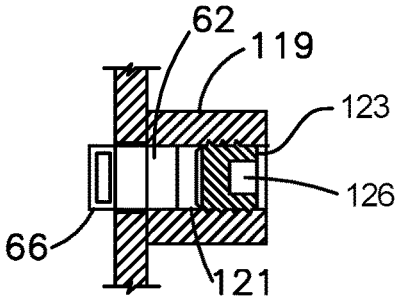
FIG. 10A is a sectional view taken along line 10A-10A in FIG. 10.
Figure 11:
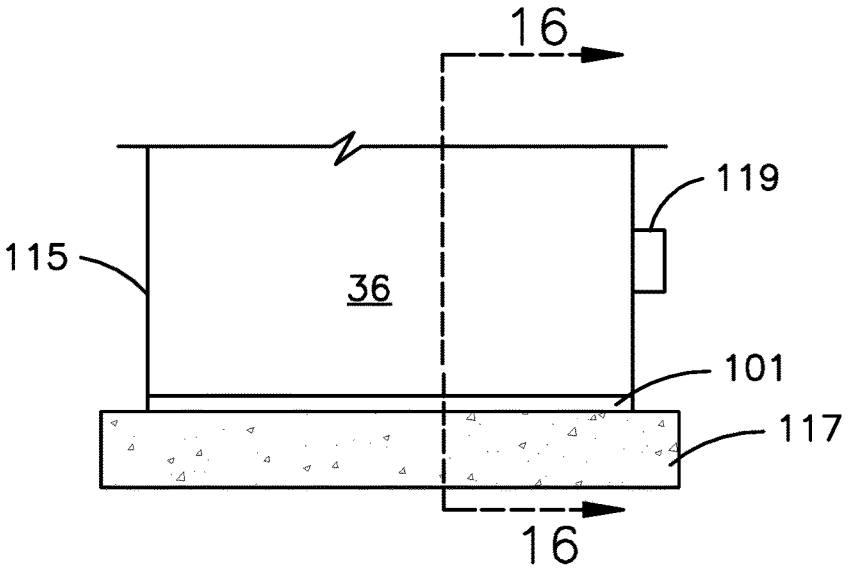
FIG. 11 is a side view of the cover rotated 90 degrees from the view shown in FIG. 10.

Referring to FIGS. 10 and 11, cover 115 preferably includes a coupler 119 extending from the sidewall 36. Coupler 119 includes an internally threaded socket 121 that will surround the key lock 62. Key lock 62 is mounted interior of the socket threads and is flush against the sidewall 36 of the cover 115. This key lock 62 is recessed within the socket 121. After the cover is secured to the locking ring and the key is locked, a plug 123 is threaded into the socket 121.

Figure 12:
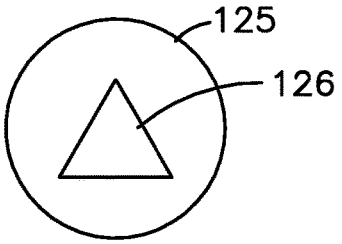
FIG. 12 is an end view of a plug that forms a portion of the embodiment of the well casing security device depicted in FIG. 9.
Figure 13:
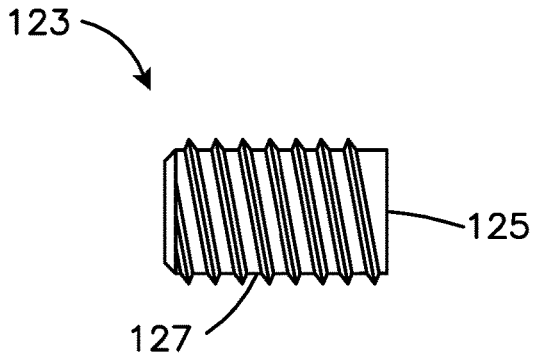
FIG. 13 is a side view of the plug.

As shown in FIGS. 12 and 13, plug 123 includes a threaded shank 127 and the head 125 of the plug includes a triangular recess 126 therein.

Figure 14:
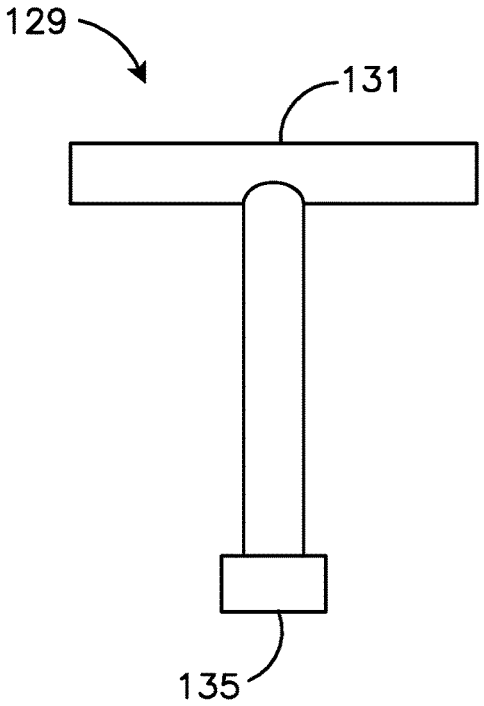
FIG. 14 is a side view of a plug removal tool according to the present invention.
Figure 15:
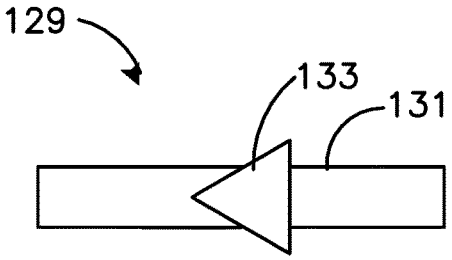
FIG. 15 is an end view of the plug removal tool as viewed from the bottom side of FIG. 14.

With reference to FIGS. 14 and 15, the well casing security device further includes a plug engagement tool 129 for inserting and removing the plug from the coupler. The plug engagement tool 129 includes a handle 131 and a projection 133 for engaging the recess 126 of the plug 123. The embodiment depicted in FIGS. 12-15 shows a triangular recess 126 in plug 123 that accepts triangular projection 133 on tool end 135 of plug engagement tool 129. It is within the scope of the invention to make the recess in the plug and the projection of shapes other than triangular. Also, it is within the scope of the invention to provide the plug with a projection and the plug engagement tool with a recess to match the size and shape of the plug. It is preferred however that the shape and size of the recess and projection do not match any of the conventional tool ends that are commercially available, such as hex wrenches of standard sizes.

With reference to FIG. 16, the second embodiment of the invention further includes a method of covering a well casing so that it is secured against unauthorized access. The method includes: (1) providing a locking support ring 101 including a ring body 103 having a plurality of apertures 111 therein, a cover including a sidewall with an inner surface, a plurality of brackets on the inner surface, a threaded coupler extending from the sidewall, (2) providing a key lock extending through the sidewall at the coupler, (3) providing a threaded plug to close the threaded coupler, (4) drilling a plurality of holes in the concrete base 117 surrounding the well casing, each of the holes coaxial with a corresponding hole in the locking support ring body, (5) attaching the ring 101 to the concrete base 117 surrounding the well casing, (6) placing the cover 115 on the locking support ring 101 and rotating the cover until the brackets 88 of the cover fully engage the slots 54 in the braces 105 on the top side of the locking support ring 101, (7) locking the key lock 62 to prevent rotation of the cover 115 with respect to the ring 101 and the well casing 26, and (8) threading the plug into the coupler to restrict access to the key slot.

Although the description above contains many specific descriptions, materials, and dimensions, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A well casing security device, comprising:

a locking support ring, said locking support ring including a ring body having an opening, a top surface, and a bottom surface;

a cover for rotational attachment to said locking support ring and said well casing, said cover including a top and a sidewall with an inner surface;

a plurality of braces extending from said top surface of said ring body;

a slot in each of said plurality of braces; and locking means for securing said cover to said locking support ring.

2. The well casing security device of claim 1, further comprising:

a plurality of brackets on the inner surface of the cover to engage said braces of said ring body; and said brackets including an upper leg and a lower leg.

3. The well casing security device of claim 1, further comprising a plurality of stabilizers on said inner surface of said cover to stabilize the cover with respect to the well casing.

4. The well casing security device of claim 1, wherein said locking means comprises a key lock having a key body.

5. The well casing security device of claim 4, further comprising a key slot and a latch on said key lock.

6. The well casing security device of claim 5, wherein said key lock further comprises:

a key body including a key axis; and said latch is perpendicular to said key axis.

7. The well casing security device of claim 4, further comprising said key body extending through said ring body of said locking support ring.

8. The well casing security device of claim 7, further comprising a key guard extending from said ring body, said key guard including a base and an arm extending over said latch.

9. The well casing security device of claim 4, further comprising said key body extending through said sidewall of said cover.

10. The well casing security device of claim 9, wherein said stabilizers extend from said top surface of said locking ring, said stabilizers integral with and at a right angle to said braces.

11. The well casing security device of claim 1, further comprising:

a plurality of positioning brackets on said ring body;

an aperture in said positioning brackets; and a set screw threaded into said aperture, said set screw to temporarily position said locking ring on said well casing.

12. The well casing security device of claim 1, wherein said braces are of arcuate shape; and said arcuate shape includes a radius to substantially match the radius of the well casing.

13. The well casing security device of claim 1, wherein said braces further comprising:

a casing engagement portion;

a cover engagement portion; and a stiffening portion.

14. The well casing security device of claim 13, further comprising:

a threaded aperture in said casing engagement portion of said brace; and a locking screw to secure said locking ring to said well casing, said locking screw in said threaded apertures of said casing engagement portion of said braces.

15. The well casing security device of claim 1, wherein said locking means further comprises:

a coupler on said sidewall of said cover;

said coupler including a threaded socket; and a key lock within said coupler.

16. The well casing security device of claim 15, further comprising:

a plug for closing said threaded socket in said coupler; and a plug engagement tool for inserting and removing said plug from said threaded socket.

17. The well casing security device of claim 16, further comprising:

a recess in said plug;

a projection on said plug engagement tool for engaging said recess of said projection on said plug engagement; and wherein said recess in said plug and said projection on said plug engagement tool are triangular shaped.

18. The well casing security device of claim 15 wherein the entirety of said plug is enclosed within said coupler.

19. A method of covering a well casing to secure it against unauthorized access comprising:

a. providing a locking support ring including a ring body having an opening, a bottom surface, a plurality of braces including slots and threaded apertures therein, and a positioning bracket including set screws threaded therein;

b. providing a key lock extending through said ring body and having a key slot accessible from said bottom surface of said ring body;

c. providing a cover including a sidewall with an inner surface and a plurality of brackets on said inner surface;

d. placing the cover on the locking support ring and rotating the cover until the brackets of the cover fully engage the slots in the braces on the top side of the locking support ring and lock the cover to the locking ring;

e. turning said key lock to lock said cover to said ring;

f. tightening the set screws against the well casing to position the locking ring with respect to the well casing;

g. removing the cover from the locking ring and well casing assembly;

h. securing the locking support ring to the well casing;

i. repeating step d; and j. locking said key lock to prevent rotation of said cover with respect to said locking ring and well casing assembly.

20. The well casing security device of claim 19, wherein securing the locking support ring to the well casing includes drilling a hole through the well casing at the location of each of said apertures in said braces and inserting a locking screw through each of said braces into the holes in the casing.

21. The well casing security device of claim 19, wherein securing the locking support ring to the well casing includes welding the locking support ring to the well casing.

22. A method of covering a well casing having a concrete slab surrounding the well casing to secure it against unauthorized access comprising:

a. providing a locking support ring including a ring body having an opening, a top surface, a bottom surface, a plurality of holes in said ring body, a plurality of braces, and a slot in each of said braces;

b. a cover including a sidewall with an inner surface, a plurality of brackets on said inner surface, and a threaded coupler extending from said sidewall;

c. providing a key lock extending through said sidewall at said coupler;

d. providing a threaded plug;

e. providing a plurality of holes in the concrete slab, each of the holes coaxial with a corresponding hole in the ring body;

f. attaching said locking support ring to the concrete slab around the well casing;

g. placing the cover on the locking support ring and rotating the cover until the brackets of the cover fully engage the slots in the braces on the top side of the locking ring and lock the cover to the locking support ring;

h. locking said key lock to prevent rotation of said cover with respect to said locking support ring and said well casing; and i. threading said plug into said coupler to restrict access to said key slot.

* * * * *